United States Patent [19]

Frommann

[11] Patent Number: 4,710,240

[45] Date of Patent: Dec. 1, 1987

[54] ANNEALING STEEL STRIP

[75] Inventor: Klaus Frommann, Meerbusch, Fed. Rep. of Germany

[73] Assignee: Mannesmann AG, Duesseldorf, Fed. Rep. of Germany

[21] Appl. No.: 840,322

[22] Filed: Mar. 14, 1986

[30] Foreign Application Priority Data

Mar. 20, 1985 [DE] Fed. Rep. of Germany ..... 3510050

[51] Int. Cl.[4] ..... C21D 9/52

[52] U.S. Cl. ..... 148/156; 148/154

[58] Field of Search ..... 148/153, 154, 156, 12.3

[56] References Cited

U.S. PATENT DOCUMENTS 4,497,674 2/1985 Ikegami et al. ..... 148/156

*Primary Examiner*—R. Dean

*Attorney, Agent, or Firm*—Ralf H. Siegemund

[57] ABSTRACT

Cold rolled steel strip is uncoiled, cleaned, and passed into an annealing furnace, wherein the strip is heated to and held at a relatively hot temperature, subsequently quenched, and coiled; after a period of storage the strip passes through the same equipment but now including additional pickling for removing an oxide layer, and the strip passes through the annealing furnace a second time, while operating said annealing furnace for heating to and holding at a lower temperature to obtain aging; thereafter the strip is coiled again.

2 Claims, 2 Drawing Figures

ANNEALING STEEL STRIP

BACKGROUND OF THE INVENTION

The present invention relates to annealing of cold rolled steel strip.

Generally, steel strip, tape, ribbon, or the like which has been cold rolled must, thereafter, be annealed in order to improve its mechanical properties towards those needed upon further working of the strips, such as deep drawing or the like. Annealing of cold rolled steel strip is usually carried out, even predominantly so, within a covered annealing device. The box annealing process is very timeconsuming, particularly because annealing as well as cool down periods up to 10 days are quite customary. Box annealing has the advantage that even small production quantities can be manufactured in an economic fashion so that the investment cost for a device of low production and throughput is, indeed, relatively small. A significant disadvantage, however, of this kind of annealing is that very strong steel, particularly so-called dual phase steel, can be made only to a very limited extent and under utilization of additional alloying element so that these steels will now become correspondingly expensive.

The disadvantages of box annealing under cover are avoided in a annealing device which operates on a continuous basis. This procedure is particularly economical when processing very strong steel. Also, the uniformity of the annealing process and of the resulting properties is better, particularly over the length of the strip. Additionally, it was found that the strip surface is cleaner and the planarity is very high. Moreover, the total processing time as compared with box annealing under cover is drastically reduced and requires, for example, only about 10 minutes. On the other hand, the continuous annealing process is disadvantaged by the fact that presently the investment costs are very high, and are, therefore, economical only when the production volume per year, for example, is significantly large so that the investment costs can be defrayed on a large production volume.

DESCRIPTION OF THE INVENTION

It is an object of the present invention to provide a new and improved device and process for annealing by means of which even small production quantities can be annealed in an economic fashion, but wherein the advantages of continuous annealing are maintained.

It is, therefore, a specific object of the present invention, to provide a new and improved method and equipment for annealing of cold rolled steel strip, wherein the strip is uncoiled from the spool and is cleaned, annealed, quenched, and dried and overaged.

It is a specific object of the present invention to provide a new and improved method and equipment, as well as operation for annealing steel strip by introducing a quasicontinuous method.

In accordance with the preferred embodiment of the present invention, the annealing processes are carried out in two major steps. In the first step the steel strip is uncoiled, cleaned, possibly buffered, and then passed into an annealing furnace wherein it is heated to annealing temperature held for a short period of time at that temperature, possibly cooled down, and subsequently quenched and dried, whereupon the strip is coiled. After a number of coils have been produced in that fashion, the strip in accordance with the second major step, is passed basically through the same equipment, except that now a previously bypassed pickling station removes the oxidation layer that was produced just prior to quenching, and then the cleaned strip is passed again through the annealing furnace but heated now only to an aging temperature, i.e. at a lower temperature, and is held thereat briefly, and cooled down but now without quenching.

Thus, the equipment is used twice, first for regular annealing of a certain amount of strip, and a certain number of coils, while thereafter the equipment is used for the overaging process, whereupon for a new set of coils the regular annealing is carried out again, followed by aging etc. By end-to-end connection of the strips of different coils, the process is carried out continuously.

The invention, therefore, is to be seen in a semi-continuous annealing structure and method, wherein the equipment as well as operation of the annealing furnace is on through twice and the furnace particularly is used as an aging furnace so that a customarily used aging furnace is not necessary. This then reduces investment costs significantly, the length of the production line is considerably reduced. The pickling device has to be arranged and adjusted upstream from the aging process, so that during the first run it is bypassed.

DESCRIPTION OF THE DRAWINGS

While the specification concludes with claims particularly pointing out and distinctly claiming the subject matter which is regarded as the invention, it is believed that the invention, the objects and features of the invention, and further objects, features and advantages thereof will be better understood from the following description taken in connection with the accompanying drawings in which;

Figure 1:
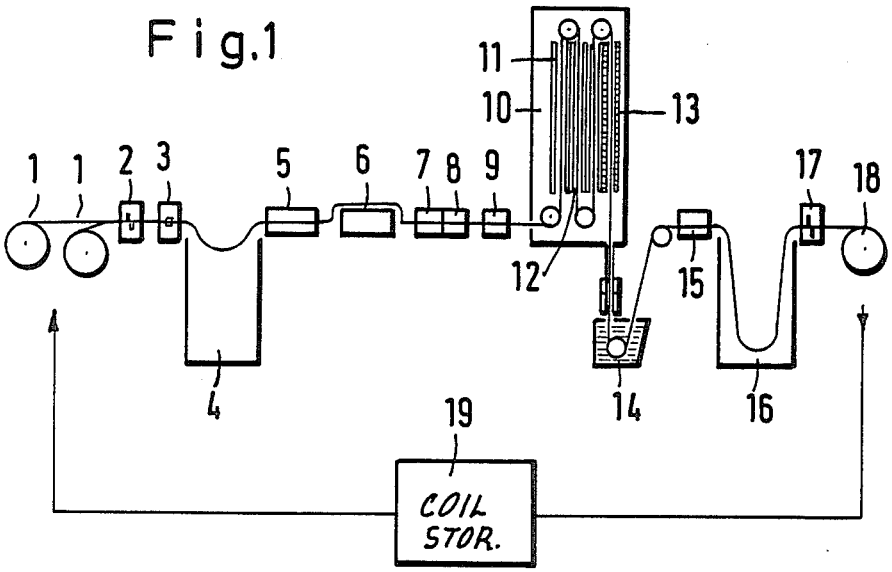
FIG. 1 illustrates somewhat schematically an annealing device during annealing operation being constructed in accordance with the preferred embodiment of the present invention for practicing the best mode thereof.

Proceeding now to the detailed description of the drawings, cold rolled steel strip 1 is uncoiled and passes a cutting device for trimming, for example, the ends of a strip or cutting large strip ends into smaller portions. The strip then runs through a welding device in which conversely shorter lengths can be reconnected to obtain a long strip whereupon the strip enters a storage or buffer zone or device 4 of conventional structure. The buffer takes care of discontinuities with regard to end-to-end connection in station 3 for strips of coils to be processed in immediate sequence. The strip 1 as withdrawin from the buffer 4 passes through a degreasing stage 5 for cleaning, a flushing or rinsing zone 7 for removing degreasing material and grease residual, a drying stage 8, and another cleaning station 9.

The strip thus cleaned then enters a generally vertically positioned annealing furnace wherein particularly in the entrance stage 11, the strip is heated to annealing temperatures, preferably inductive heating is being used. The strip is then held at annealing temperatures for a relatively short time in a holding zone 12 there being protective gas, provided to surround the strip particularly in that holding zone. Subsequently, the strip will be cooled down by means of cool protective gas from the holding annealing temperature, which is, for example, between 700 and 850 degree centigrade. The strip is thus cooled slowly in the cooling zone 13 to a lower temperature. As the strip emerges from the furnace, it is passed into a quenching tank 14 for high speed quenching, whereby the quenching speed, depending upon strip thickness, may range from 500 to 2,000 degree centigrade per second. Depending on the type of steel, the holding may continue up until the strip emerges from the furnace, so that quenching obtains directly from the holding temperature. As the strip emerges from the furnace, some oxidation of the surface is to be expected. Following quenching the wet strip is dried in a drying station 15, again passes through a buffer or other temporary storage facility 16, from which it is withdrawn and coiled on a spool 18. A cutter 17 of conventional design may be provided in front of the coiling structure 18, to sever strip length from each other, particularly after a coil has been completed and another is to be started.

Figure 2:
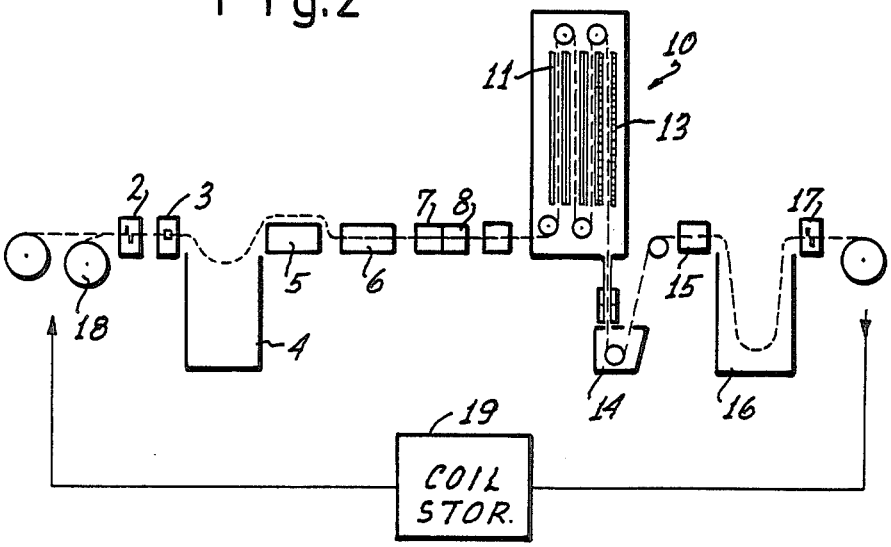
FIG. 2 is a similar view and shows the same device but during strip aging operation.

The results then in annealed and quenched coils, the steel of which, however, still contains a relatively large portion of carbon which is solved in the iron, so that the strip material is not yet suited for further working. Moreover, as stated, the surface of the strip is covered with a thin oxide layer which was produced on emergence from the annealing furnace. Accordingly then, a second pass through the device shown in FIG. 1 is provided for, and the second pass is shown in FIG. 2. During the second pass, the strip is pickled and overaged, respectively, for removing the oxide layer and for causing the carbon to partially or completely to precipitate.

The procedure, therefor, is as follows. After, by means of the device shown in FIG. 1, a number of coils has been processed through the described annealing procedure, these coils are generally stored in the facility 19, and are then passed as coils to be processed to assume the role of coils 1. It is, therefore, required, that a dummy strip be provided and the first strip on the first coil is connected thereto by welding which is one of the tasks of the welding station 3. This dummy strip was with its leading end, welded previously through the tail end of the last strip that was processed in the stated manner of annealing.

Now, on the second run as illustrated by dotted lines in FIG. 2, the strip bypasses the cleaning station 5 and instead passes through the pickling station 6 which was bypassed during the first run. The neutralizing, rinsing, and drying stages 7, 8, and 9, respectively, are used as before. Now, again, the strip passes into the furnace 10 and again is inductively heated for the overaging process, in this case, the strip is heated to a lower temperature. Depending on the quality of the steel, such temperature is between 200 and 400 degree centigrade. That temperature is now maintained in the zone 12 for $\frac{3}{4}$ of a minute to 1 minute whereby, depending on the temperature, the carbon solved in the iron is, in fact, partially or even completely precipitated. Following this aging process, the strip is cooled down by means of cool protective gas to a temperature below 100 degrees centigrade so that it will no longer oxidize on emergence from furnace 10. Thereafter, the strip passes through the quenching tank 14 simply for ease of operation but no quenching occurs, in other words, the tank is empty. Still, thereafter, stages 15, 16, and 17 are passed through, except for the buffer 16 no further operations are necessary.

After a sufficient and desired number of coils have passed through the station again in accordance with the second major process step for providing the aging, operation returns to annealing as was described with reference to FIG. 1, and a continuation of the process obtains in that again now the trailing edge of the last overaged strip, still is connected to the dummy strip, and the trailing edge of that dummy strip will now be connected to the leading edge of a new coil; while the dummy strip is passed through the equipment, the operational changeover occurs from the procedure of aging as per FIG. 2 to the procedure of annealing as per FIG. 1.

The invention is not limited to the embodiments described above, but all changes and modifications thereof, not constituting departures from the spirit and scope of the invention, are intended to be included.

I claim:

1. In a method of annealing cold rolled steel strip wherein the strip is uncoiled, cleaned, and passed into and through continuously operating annealing furnace wherein the strip is heated to and held at a relatively hot temperature, said strip after leaving the furnace being subsequently quenched, the improvement comprising: drying and coiling said strip; passing the strip again through the same equipment including additionally pickling of removing an oxide layer; and passing the strip a second time through the annealing furnace, while operating said annealing furnace for heating to and holding at a lower temperature said relatively hot temperature to obtain aging and coiling the strip again.

2. Method as in claim 1, wherein for purposes of a quasi-continuous operation a dummy strip is welded to the trailing end of a strip as well as to a leading end of another strip, while the equipment is changed over from annealing to aging or vice-versa as the dummy strip passes through.

* * * * *